United States Patent [19]

Wilburn et al.

[11] 4,010,436

[45] Mar. 1, 1977

[54] ELECTRICAL INDUCTIVE APPARATUS

[75] Inventors: Garlington C. Wilburn, South Boston; John G. Aldworth, Halifax, both of Va.; Robert Lugosi, Monroeville; Alan T. Male, Franklin Borough, both of Pa.

[73] Assignee: Westinghouse Electric Corporation, Pittsburgh, Pa.

[22] Filed: Apr. 15, 1976

[21] Appl. No.: 677,332

[52] U.S. Cl. ..... 336/223

[51] Int. Cl.[2] ..... H01F 27/28

[58] Field of Search ..... 336/223, 195, 222; 174/109, 117 R, 126 R

[56] References Cited

UNITED STATES PATENTS 1,041,293 10/1912 Keller ..... 336/223 X

*Primary Examiner*—Thomas J. Kozma
*Attorney, Agent, or Firm*—D. R. Lackey

[57] ABSTRACT

Electrical inductive apparatus including a winding disposed in inductive relation with a magnetic core. The winding includes a plurality of conductor turns formed of an electrically conductive material having a predetermined cross sectional configuration. The predetermined cross sectional configuration is selected such that an interlocking structure is formed in which the conductor turns of an axially aligned layer of turns are restrained against relative axial movement.

11 Claims, 10 Drawing Figures

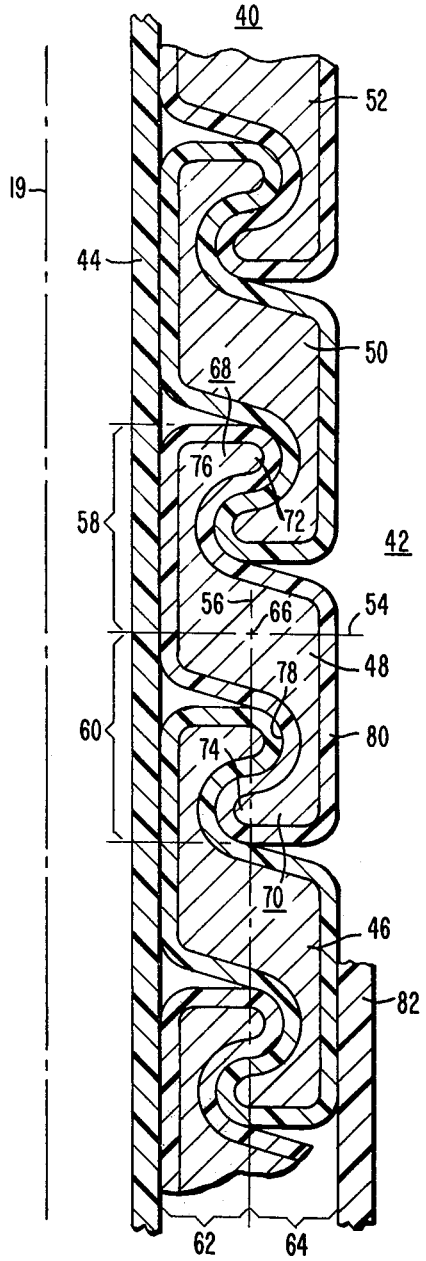
FIG.3
FIG.4
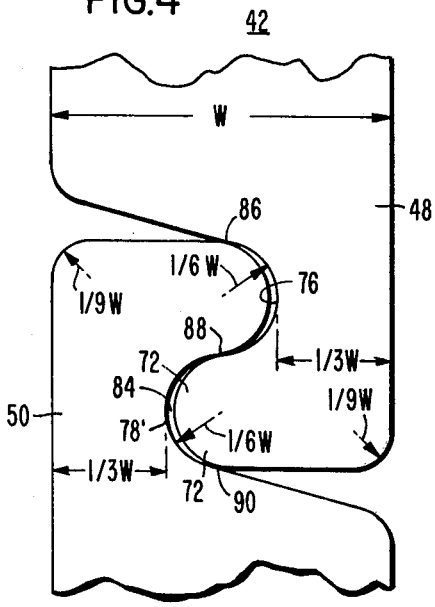
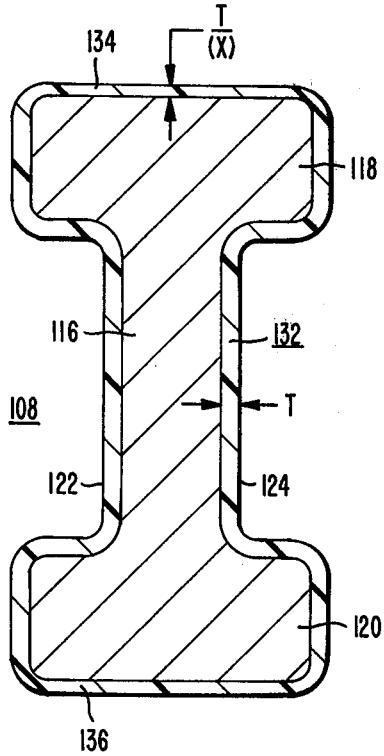
FIG.6

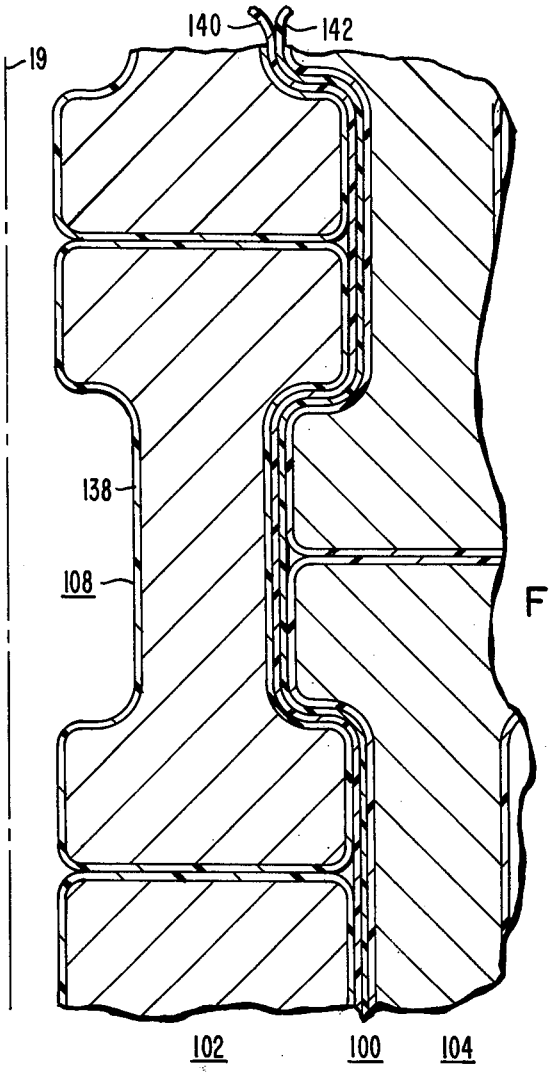
FIG.7
FIG.5
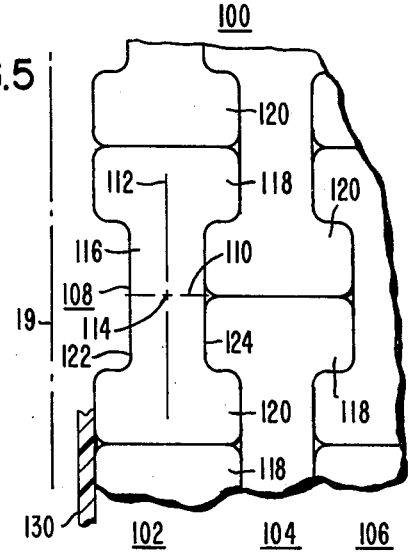
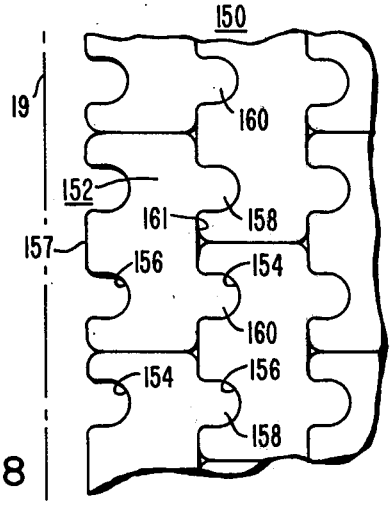
FIG.8
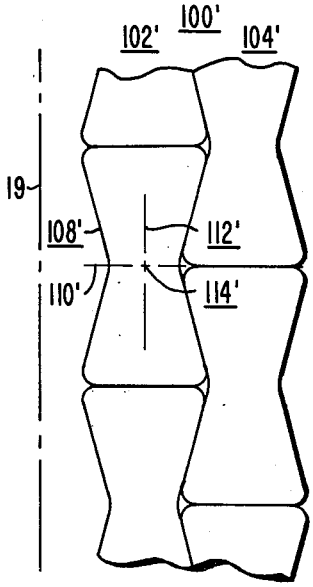
FIG.5A
FIG.9
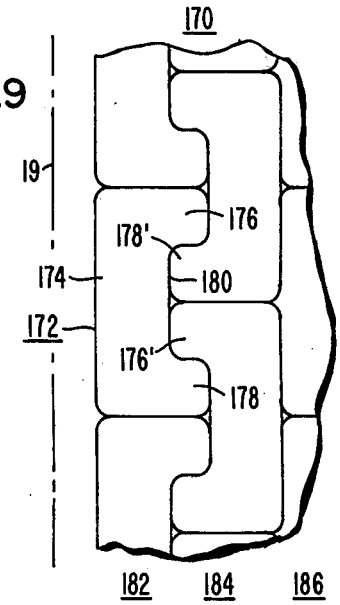

ELECTRICAL INDUCTIVE APPARATUS

BACKGROUND OF THE INVENTION

1. Field of the Invention

The invention relates in general to electrical inductive apparatus, such as power transformers, and more specifically to new and improved winding structures for such apparatus.

2. Description of the Prior Art

Power transformers of the core-form type initially were constructed with circular shaped coils disposed about cruciform shaped legs of a magnetic core. The high cost of vault space in large cities, provided the incentive to develop a more compact power transformer for network applications, and the rectangular core and coil type of construction was developed. The rectangular construction has proven itself to be an extremely rugged, reliable design, as it must be in order to withstand the cable fault surges, switching surges and overload duty characteristics of network operation.

While the rectangular construction is ideally suited to withstand repeated short circuit stresses, means are constantly sought for further improving the strength of the windings to enable them to withstand the tremendous forces applied to the windings during a short circuit condition. During a short circuit applied to the secondary winding of a rectangular core-form power transformer, the outer or high voltage winding is subjected to a force radially outward, and the inner or low voltage winding is subjected to a force directly radially inward.

If it were possible to build a transformer in which the high and low voltage winding or coils were exactly the same length, with uniform and linear distribution of ampere turns per unit of length, and with the ends of the windings in the same plane, the radial forces would be the only significant short circuit forces. In practice, however, taps and manufacturing variations produce a vertical displacement between the electrical centers of the high and low voltage windings, and since the fundamental force of radial repulsion effectively acts between the electrical centers, a force component exists which tends to move the high and low voltage windings in opposite axial directions.

The short circuit force on a winding is proportional to the square of the current in the winding. Short circuit currents may typically be 15 or more times the normal full load current, and the force on the winding is proportional to the square of the current flowing through the winding. The short circuit forces are also increased due to displacement of the first half cycle of current, which displacement is a function of the ratio of the resistance to the reactance of the transformer. The increase in short circuit forces due to this displacement is 3 to 4 times the value of the force with symmetrical current. Thus, the short circuit forces may be 800 to 1000 times the forces existing at normal full load current, and since the axial component is typically in the range of 7 to 15% of the total force, the force which tends to move the windings axially apart during a short circuit is indeed substantial.

SUMMARY OF THE INVENTION

Briefly, the present invention is a new and improved power transformer constructed to provide mechanically strong windings which resist axial separation of the conductor turns. The conductor turns of at least the high voltage winding are conventionally constructed of strap material, and depending upon current ratings, the high and low voltage windings may both be formed of strap material. The strap material is selected to have a cross sectional configuration such that the process of winding the strap material forms an interlocking arrangement between the conductor turns which resists axial separation of the turns in an axially aligned layer of turns. In one embodiment, the cross sectional configuration of the conductive strap material is selected such that complementary portions overlap as a layer is being wound, to provide a layer in the winding in which the turns interlock themselves. In other embodiments, the cross sectional configuration is selected such that the conductor turns of one layer co-act structurally with the turns of one or more of the adjacent layers to provide an interlocking structure in which the turns of a layer are restrained against relative axial movement or separation, and adjacent layers are restrained against relative axial movement.

The electrically conductive strap material is preferably insulated with an adherent coating of an electrical insulating material, such as a cured coating of an epoxy resin, but insulating tape material may also be used, such as between the layers of a winding.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 3 is a cross sectional view of the winding layer shown in FIG. 2, taken between and in the direction of arrows III—III;

FIG. 4 is an enlarged view of the strap conductor used in the winding layer of FIGS. 2 and 3, illustrating the cross sectional configuration of the strap, and dimensional relationships which may be used to form the complementary or interlocking portions of the conductor;

FIG. 5 is a fragmentary, cross sectional view of a winding structure constructed according to another embodiment of the invention in which the layers of the winding interlock to restrain the conductors of a layer, as well as adjacent layers, against relative axial movement;

FIG. 5A is a fragmentary, cross sectional view of a winding structure which is a modification of the winding structure shown in FIG. 5;

FIG. 6 is an enlarged cross sectional view of the strap conductor used in the FIG. 5 embodiment, illustrating an electrical insulating arrangement which may be used to provide both turn and layer insulation;

FIG. 7 is an enlarged view of the winding structure shown in FIG. 5, illustrating another electrical insulating arrangement which may be used to provide the layer and turn insulation;

FIG. 8 is a fragmentary, cross sectional view of another winding structure constructed according to an embodiment of the invention in which the layers of the winding are interlocked to restrain both the conductor turns in a layer, and the layers themselves, against relative axial movement; and FIG. 9 is a fragmentary, cross sectional view of still another winding structure constructed according to an embodiment of the invention in which each axial layer of conductors is capable of co-acting with a single adjacent layer of conductors, instead of with two adjacent layers, as in the FIGS. 5 through 8 embodiments.

DESCRIPTION OF PREFERRED EMBODIMENTS

Figure 1:
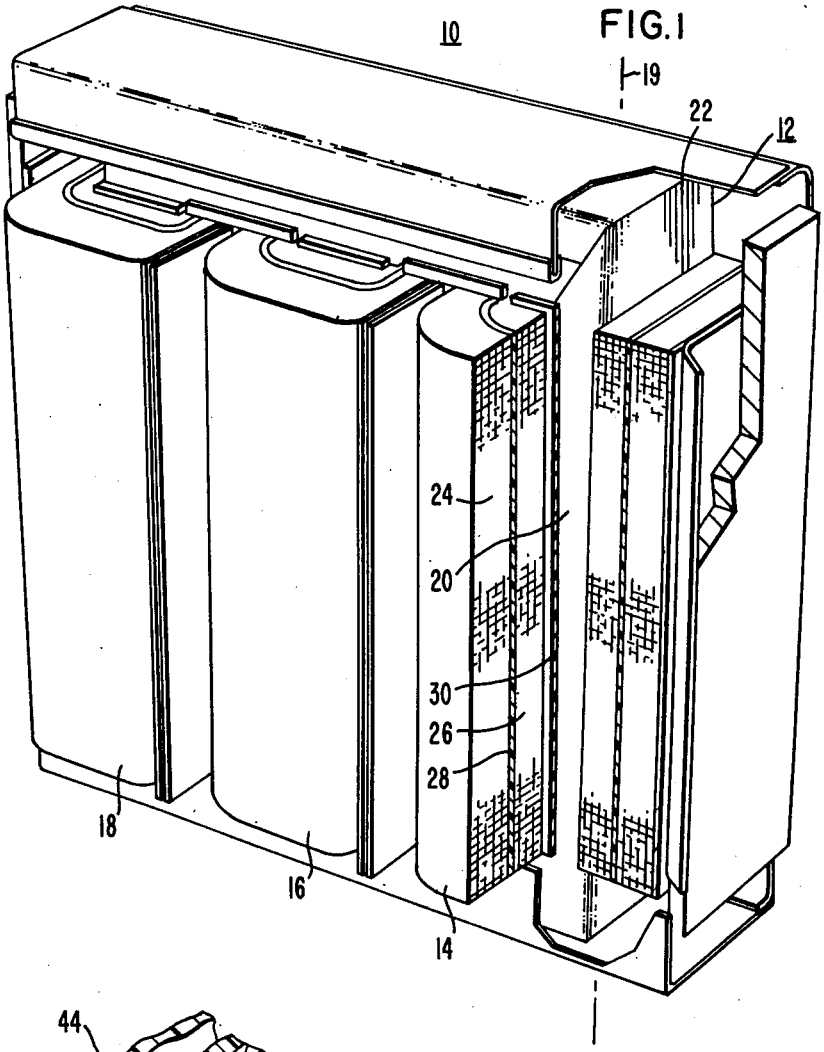
FIG. 1 is a perspective view, partially in section, of a rectangular core-form power transformer which may be constructed according to the teachings of the invention.

Referring now to the drawings, and to FIG. 1 in particular, there is shown a transformer 10 of the rectangular core-form type which may be constructed according to the teachings of the invention. Transformer 10 includes a magnetic core assembly 12, and a plurality of electrical winding assemblies, such as those shown at 14, 16 and 18. The magnetic core assembly 12 is of the type which includes a plurality of leg portions, such as leg portion 20, which are disposed in spaced, parallel relation, and they have a substantially rectangular cross-section. FIG. 1 illustrates only one complete winding assembly and leg portion of the magnetic core in detail, as the additional winding assemblies and leg portions would be similar. Any number of winding leg portions and electrical winding assemblies may be utilized, depending upon the particular application. The leg portions of the magnetic core assembly 12 are joined by upper and lower yoke portions. The various leg and yoke portions are each formed of a stack of metallic laminations, such as laminations 22, which are formed of a grain oriented silicon steel, with the leg laminations making a joint with a yoke lamination in the same plane. Transformer 10 may be single or polyphase, having two or more leg portions.

The winding assemblies, such as winding assembly 14, include high and low voltage windings or coils 24 and 26, respectively, concentrically disposed about one of the leg portions of the magnetic core 12, such as leg portion 18 which has a central axis 19 coaxial with the center lines or central axes of the high and low voltage windings 24 and 26, respectively. The high and low voltage windings or coils 24 and 26 are separated by suitable high-low insulation 28, with the complete winding structure being insulated from the magnetic core leg by a winding tube 30. Winding assembly 14 has a rectangular opening therein for closely coupling the winding assembly with its associated leg portion of the magnetic core, and the winding assembly has a substantially rectangular outer configuration.

Depending upon the current rating of a winding, the low voltage winding 26 may be constructed of strap conductor, or sheet conductor. The sheet conductor is used for the lower voltage, high current classes, while the strap conductor is used for the higher voltage, lower current classes. The high voltage winding 24 is generally wound of strap conductor since the current magnitudes will be relatively low, and the strap type of winding more easily permits taps.

The present invention is directed to transformer windings formed of strap conductor, and is thus applicable to the high voltage winding 24, and, when strap conductor is used for the low voltage winding 26, it applies equally to both the high and low voltage windings. For purposes of example, FIG. 1 illustrates both the high and low voltage windings 24 and 26 as being formed of strap conductor. The strap conductor conventionally has a rectangular cross sectional configuration, and is taped with an insulating tape material, such as cellulosic tape, in order to provide turn insulation. The strap conductors are wound to provide a plurality of conductor turns aligned in an axial layer, and then another layer is wound upon the preceding layer, utilizing suitable layer insulation between adjacent layers.

In the present invention, the cross sectional configuration of the strap conductor is modified to provide a winding structure in which certain conductor turns are interlocked to restrain relative axial movement between the conductor turns of a layer, and in certain embodiments, the layers are additionally restrained to prevent relative axial movement between adjacent layers.

Figure 2:
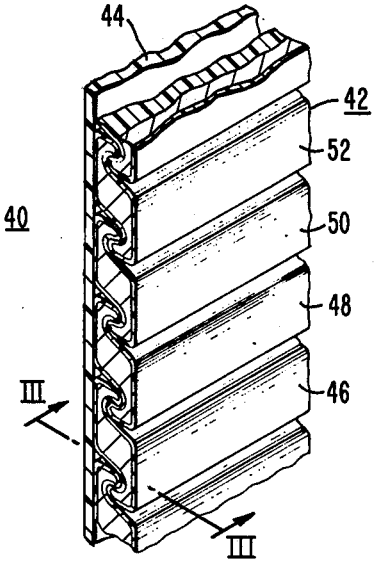
FIG. 2 is a fragmentary, perspective view of a single layer of axially aligned conductor turns constructed according to the teachings of the invention, which layers may be used in the high voltage winding, the low voltage winding, or both, of the transformer shown in FIG. 1.

FIG. 2 is a fragmentary, perspective view of a layer 40 of a winding which may exist in either or both of the high and low voltage windings 24 and 26. In this embodiment, the conductor turns of the layer co-act to provide the restraint against relative axial movement or separation. Winding layer 40 is formed of a conductor 42 which is positioned on the outside of a layer of insulating material 44. FIG. 3 is an enlarged, fragmentary, cross sectional view of layer 40, taken between and in the direction of arrows III—III in FIG. 2, illustrating the first four turns 46, 48, 50 and 52, starting at the bottom of the layer. During the winding process, the conductor 42 would be wound about layer insulating member 44 to provide the first turn 46, and the turns 48, 50 and 52 would follow in succession. Thus, the turns of the layer 40 occupy the same radial position within the rectangular winding structure about the axis 19, but occupy different axial positions within the winding and within the winding layer 40.

The turns of the conductor 42 are interlocked in order to prevent axial movement between the conductor turns. The interlocking of the turns occurs automatically during the construction of the winding layer 40 due to the cross sectional configuration of the conductor 42. Thus, a winding formed from the conductor 42 is not as susceptible to conductor-turn separation as a winding constructed of conventional strap conductor material. Therefore, the short circuit strength of a winding constructed according to the disclosed interlocking arrangement is better than that provided by conventional prior art techniques.

FIG. 3 illustrates the details of the conductor shape or configuration which provide the interlocking arrangement. For descriptive purposes, the cross sectional configuration of conductor 42 may be divided into four regions or portions which are separated by horizontal and vertical axes or lines 54 and 56 drawn through a center of the conductor 48. The axis or line 54 extends in a radial direction through the axial center of the cross section of the conductor turn 48, and is perpendicular to the winding axis 19. The axial and radial directions are those corresponding to the complete winding formed by the strap conductors. The axis or line 54 separates the cross sectional configuration into portions 58 and 60 which are located above and below, respectively, the axis 54. Similarly, an axis or line 56 extends in an axial direction through the radial center of the conductor cross section. This line divides the cross sectional configuration of the conductor 42 into portions 62 and 64 which include the cross sectional area located on the left and right-hand sides, respectively, of the line 56. It will be noted that conductor 42 has upper and lower portions 68 and 70, respectively, which are in rotational symmetry about an axis 66 disposed perpendicular to the intersection of the axes 54 and 56. In other words, if conductor 42 is rotated 180° about axis 66, portion 68 will assume the position of portion 70, and portion 70 will assume the position of portion 68. This complementary arrangement permits a later wound conductor-turn to overlap a previously wound turn of the same conductor and to enter into an interlocking engagement therewith.

The interlocking elements of the conductor 42 include the projections 72 and 74 which extend across the vertical axis or line 56. The cross sectional configuration also includes depressions 76 and 78 which permit engagement with complementary projections on adjacent turns of the conductor 42. The projections and depressions cooperate to prevent relative axial movement of the conductor turns due to electromechanical forces exerted thereon under high stress conditions.

As illustrated in FIG. 3, conductor 42 preferably includes a tenacious coating 80 of electrical insulating material disposed uniformly about its outer surface, such as a cured coating of epoxy resin. The epoxy resin may be advantageously applied in powder form by electrostatic techniques, as this method uniformly coats non-uniform shapes, but other arrangement may be used. When layer 40 is finished, an insulating member 82 is wrapped about layer 40 and the next layer may be wound directly over the insulating member 82.

FIG. 4 is an enlarged, fragmentary view of conductor turns 48 and 50 shown in FIG. 3, and it illustrates the relative dimensions of complementary conductor turns constructed according to a specific embodiment of the invention. The space 84, which is between the depression 78 and the projection 72 is exaggerated in FIG. 4 to indicate that the radii of the two curves may be different in order to allow contact between the conductor-turns at the regions indicated at 86, 88 and 90.

In this specific embodiment, wherein the width dimension of the conductor 42 is W, the depression 64 extends into the conductor cross section by a dimension which provides a separation distance ⅓ W between the depression and the opposite edge of the conductor. Similarly, the depression 76 has a separation distance ⅓ W from the edge of the adjacent conductor. The overall thickness of width W of the conductor is three times the separation distances between the depressions and conductor edges. This requires that the depressions have a radius of curvature equal to one-half the separation distances ⅓ W, or 1/6 W. The remaining edges of the conductor may be curved with a radius equal to 1/9 W.

FIG. 5 is a fragmentary view, in section, of a winding structure 100 constructed according to another embodiment of the invention. The winding structure 100 includes a plurality of layers of conductor turns, such as layers 102, 104 and 106. In this embodiment, the conductor turns of a layer do not overlap one another, but the cross sectional configuration of the conductor is selected such that the turns of adjacent layers co-act to not only prevent relative axial movement between the conductor turns of any selected layer, but also to prevent relative axial movement between adjacent layers of conductors.

More specifically, winding 100 is wound of a conductor 108 which is symmetrical about horizontal and vertical axes 110 and 112, respectively, and in 180° rotational symmetry about an axis 114 perpendicular to the intersection of axes 112 and 114. Conductor 108 has substantially an I-shaped cross sectional configuration, having a central, substantially rectangularly shaped portion 116, an upper substantially rectangularly shaped portion 118, and a lower substantially rectangularly shaped portion 120. Portions 118 and 120 extend outwardly from the major sides 122 and 124 of the center portion 116 to provide recesses on opposite sides of the vertical axis 112 for receiving the upper and lower portions of conductor turns in the next adjacent layer, or layers.

Conductor 108 is wound about an insulating member 130 with the upper portion 118 of one conductor turn butting against the lower portion 120 of the next adjacent conductor turn to form the first axially extending layer 102. The winding would then progress to the next adjacent layer with a finish-start connection. The conductor turns of the next layer 104 are offset radially from the turns of layer 102 by a distance equal to ½ the length of the conductor strap measured in the axial direction of the winding, with the upper portion 118 of one turn projecting into the lower portion of the recess 124 defined by a conductor turn of the layer 102, and the lower portion 120 of the next adjacent turn would project into the upper portion of the recess 124. Thus, one conductor turn of one layer locks two conductor turns of an adjacent layer against relative axial movement, and conductor turns of an intermediate layer lock four conductor turns against relative axial movement, two in the adjacent inner layer and two in the adjacent outer layer. This arrangement also prevents relative axial movement between the layers 102, 104 and 106, as cooperative interaction of the layers results in an interlocking structure which extends throughout the winding assembly.

FIG. 5A is a fragmentary view, in section, of a winding structure 100' which illustrates a modification of the winding 100 shown in FIG. 5. Winding 100' utilizes a conductor 108' having a cross sectional configuration similar to a "bow tie," instead of the I-shape of conductor 108. Like reference numerals except for a prime mark indicate components similar to those of FIG. 5.

FIG. 6 is an enlarged cross sectional view of conductor 108 shown in FIG. 5, illustrating a suitable arrangement for insulating the conductor with a coating 132 of electrical insulation, such as an epoxy coating, which provides both layer and turn insulation. The electrostatic powder coating technique enables the coating thickness of an electrical insulating material to be controlled. Thus, if a coating thickness T is required to provide the necessary layer insulation, the extreme ends 134 and 136 of portions 118 and 120, respectively, may have a coating T/(X), which coating is less than the thickness T, and it would be selected to provide the necessary turn-to-turn insulation.

Alternatively, as illustrated in FIG. 7, which is an enlarged view of the winding 100 shown in FIG. 5, the conductor 108 may have a uniform coating 138 of electrical insulation disposed thereon, with the thickness being selected to provide the necessary turn insulation, and one or more layers of insulating tape, indicated generally at 140 and 142, may be wound about each layer of conductor turns before the next layer of conductor turns is applied thereto. The tape 140 and 142 should be overlapped in the axial direction, and it should be stretchable, such as a crepe paper tape, in order to enable the interlocking structure to occur despite the intervening layer insulation.

The insulating arrangements shown in FIGS. 6 and 7 may also be applied to conductor 108′ shown in FIG. 5A. FIG. 8 is a fragmentary view, in section, of a winding 150 constructed according to another embodiment of the invention in which the conductor turns of each layer are restrained against relative axial movement, and the layers are restrained against relative axial movement. In this embodiment, a conductor 152 is provided which has two spaced depressions 154 and 156 on its inner surface 157, and two spaced projections 158 and 160 on its outer surface 161, with the inner and outer surface being referenced relative to the winding axis 19. Conductor turns of adjacent layers are offset axially ½ turn such that the projections 158 and 160 on two adjacent turns of one layer enter the depressions 154 and 156, respectively, of a single conductor turn of the next layer. Conductor 152 may be insulated with a coating of electrical insulating material, such as illustrated in FIG. 6.

FIG. 9 is a fragmentary cross sectional view of a winding 170 constructed according to an embodiment of the invention in which each axial layer of conductors is capable of co-acting with a single adjacent layer, instead of two adjacent layers, as in FIGS. 5–8 embodiments. Winding 170 is formed of a conductor 172 which includes a substantially rectangular central portion 174, and substantially rectangular upper and lower portions 176 and 178. The upper and lower portions 176 and 178 extend outwardly from only one side of portion 174, instead of on both sides as in the FIG. 5 embodiment, providing a single recess 180 for cooperating with the portions 178 and 176 of the conductors in the next adjacent layer. It will be noted that the conductors of the first or innermost layer 182 are oriented such that they have a C-shape when viewed in FIG. 9, while the conductor 172 is oriented in the opposite direction in the next layer 184. The third layer 186 is again oriented similar to the first layer 182, etc. Thus, the finish-start connections between the layers must be twisted 180° in order to obtain the proper orientation for the next layer. It will be noted that the conductor turns of all layers are interlocked to restrain relative axial movement of the turns of a layer, and the layers are interlocked in pairs, with relative axial restraint being provided between the interlocked pairs. Conductor 172 may be insulated with a coating of electrical insulating material, such as illustrated in FIG. 6, or the winding structure 170 may be insulated as shown in the embodiment of the invention set forth in FIG. 7.

We claim as our invention:

1. A transformer, comprising:

a magnetic core, and a winding structure disposed in inductive relation with said magnetic core, said winding structure including a plurality of conductor turns formed of an electrically conductive material having a predetermined cross sectional configuration, said plurality of conductors turns being arranged such that at least certain of the conductor turns are aligned in a first axially extending layer of conductor turns, with said predetermined cross sectional configuration of the electrically conductive material providing an interlocking structure in which each conductor turn includes at least two portions which axially overlap other conductor turns of said winding to restrain the conductor turns of the first axially extending layer against relative axial movement.

2. The transformer of claim 1 wherein the predetermined cross sectional configuration of the electrically conductive material defines a portion on one conductor turn which is complementary to a portion on the next adjacent conductor turn with the conductor turns aligned in an axially extending layer, the complementary portions of adjacent conductor turns of the first axially extending layer being engaged to provide the restraint against relative axial movement.

3. The transformer of claim 2 including electrical insulating means disposed to electrically insulate the engaging portions of the adjacent conductor turns, with the electrical insulating means including a tenacious coating of electrical insulating material disposed on the electrically conductive material.

4. The transformer of claim 1 wherein certain of the conductor turns are aligned to provide a second axially extending layer of conductor turns which is coaxial with and radially adjacent the first layer, and wherein the predetermined configuration of the electrically conductive material is selected such that the conductor turns of one layer restrain the conductor turns of the other against the relative axial movement.

5. The transformer of claim 4 including electrical insulating means disposed to electrically insulate the conductor turns of a layer and to electrically insulate adjacent layers, with the electrical insulating means including a tenacious coating of electrical insulating material disposed on the electrically conductive material.

6. The transformer of claim 5 wherein the coating of electrical insulating material has graded thickness dimensions selected such that the coating portion which functions as layer insulation is thicker than the coating portion which functions as turn insulation.

7. The transformer of claim 5 wherein the electrical insulating means includes insulating tape material disposed between the radially adjacent layers, with said insulating tape material being conformable to the configuration of the conductor turns of the radially adjacent layers.

8. The transformer of claim 1 wherein certain of the conductor turns are aligned to provide a plurality of axially extending, radially adjacent layers of conductor turns, which layers are coaxial with and radially adjacent the first layer, and wherein the predetermined configuration of the electrically conductive material is selected such that the conductor turns of one layer restrain the conductor turns of each of the immediately radially adjacent layers against relative axial movement.

9. The transformer of claim 8 including electrical insulating means disposed to electrically insulate the conductor turns of a layer and to electrically insulate adjacent layers, with the electrical insulating means including a tenacious coating of electrical insulating material disposed on the electrically conductive material.

10. The transformer of claim 9 wherein the coating of electrical insulating material has graded thickness dimensions selected such that the coating portion which functions as layer insulation is thicker than the coating portion which functions as turn insulation.

11. The transformer of claim 9 wherein the electrical insulating means includes an insulating tape material disposed between the radially adjacent layers, with said insulating tape material being conformable to the configuration of the conductor turns of the radially adjacent layers.

* * * * *